US006260731B1

(12) United States Patent
Cummings

(10) Patent No.: US 6,260,731 B1
(45) Date of Patent: Jul. 17, 2001

(54) LID AND CLIP COMBINATION FOR CHILD'S CUP

(75) Inventor: Tony P. Cummings, 824 Knoll Manor Ct., Cedar Hill, TX (US) 75104

(73) Assignee: Tony P. Cummings, Cedar Hill, TX (US)

( * ) Notice: Subject to any disclaimer, the term of this patent is extended or adjusted under 35 U.S.C. 154(b) by 0 days.

(21) Appl. No.: 09/393,663

(22) Filed: Sep. 10, 1999

(51) Int. Cl.[7] ..... B65D 39/08
(52) U.S. Cl. ..... 220/717; 224/148.7
(58) Field of Search ..... 220/717; 224/666, 224/667, 148.7

(56) References Cited

U.S. PATENT DOCUMENTS

| | | | | |
|---|---|---|---|---|
| D. 291,044 | * | 7/1987 | Canning | 224/148.7 |
| 2,384,718 | * | 9/1945 | Witherspoon | 220/764 |
| 4,708,273 | * | 11/1987 | Grant | 224/148.7 |
| 4,746,042 | * | 5/1988 | King | 224/148.7 |
| 4,955,572 | * | 9/1990 | Simmons | 224/148.7 |
| 5,823,385 | * | 10/1998 | Cautereels | 220/764 |
| 5,890,620 | * | 4/1999 | Belcastro | 220/717 |
| 5,988,425 | * | 11/1999 | Yehl et al. | 220/717 |

* cited by examiner

*Primary Examiner*—Joseph M. Moy

(57) ABSTRACT

A lid and clip combination for a child's drinking cup wherein the lid is permanently attached to a clip or conversely, the lid and clip are molded together to form a unitary construction. The lid is designed to secure to the top part of a cup which is designed to hold liquid. The cup, and therefore the lid, is of a size and shape suitable for small children. The lid comes in various sizes all of which are designed with the express purpose of securing the various lids to cups especially designed for children. The clip also comes in various shapes and designs and is made of a flexible material such as a flexible plastic and serves the same purpose as a clip for a pager or cell phone. The bottom part of the clip is rounded to prevent puncture either to the child's clothing or skin. The lid has a specialized drinking spout which is raised above the generally horizontal surface of the lid. The raised drinking spout has drinking holes therein which provide a way to extract the liquid from the cup. Located along the horizontal surface of the lid are a plurality of air holes. A first set of air holes are located adjacent the clip while a second set of air holes are located adjacent the drinking spout. With the lid and clip combination properly secured to the cup, the child can safely attach the clip, and therefore the cup, to his or her waist band or belt and proudly and confidently walk around having immediate access to the cup and consequently, the liquid therein.

5 Claims, 5 Drawing Sheets

LID AND CLIP COMBINATION FOR CHILD'S CUP

BACKGROUND OF THE INVENTION

1. Field of the Invention

The invention relates generally to cup or container lids. More specifically, the invention relates to a lid and clip combination removably attached to a child's drinking cup.

2. Description of Related Art

Drinking cups designed for children have been a boon for parents and guardians for some time now. Little children can now have their "own" pint sized cups and have them filled with their favorite beverages. Most of these specialized drinking cups come equipped with lids having openings suitable for the small mouths of children. The lids are designed to help prevent spillage of the liquid contained therein. As great and innovative as these children's cups are, however, parents have faced a few problems with their use. Often, a parent will look to give their child milk or juice, only to discover that their child can not find his or her special cup. This can be aggravating for the parent who must now search around the child's play area or seating area in a vehicle or amongst the child's toys. The situation is not helped when the child continues to ask for the drink during the search for the cup. Some children, in fact, want to drink only from their special cup and sometimes give their parents "headaches" by crying and insisting on having their special cup. The not so simple matter of a missing cup can add to an already hectic and stress filled day in the life of a parent.

Parents, who are always looking for ways to make their life less stressful, would immediately appreciate the benefits of a way to have their child's favorite cup with the child at all times, therefore eliminating the frantic search missions for lost cups. In addition, children, who love to imitate adults, would love to be able to place their favorite cups on their waist bands or belts in the same fashion that their parents secure their pagers or cell phones. Having the ability to place their favorite drinking cups on their person would increase the self-esteem, responsibility and feeling of importance to children everywhere. This benefit is in addition to the benefits of added convenience, access to the cup at all times and the freeing up of their hands while walling. Furthermore, the children would gain a feeling of responsibility by always having their cup with them and not having to ask their parents to hold the cup for them. There is, therefore, a need for a lid and clip combination attachable to a child's cup which permits the child to secure a favorite cup to his or her waist band or belt eliminating the safety hazard associated with simultaneously waling and trying to grasp a cup with both hands. Furthermore, having the capability to secure the lid and clip combination to a car seat, via sleeve or pouch, would render the cup less likely to become a weapon or flying object inside the car. The present invention provides such a device.

Lids and/or lid and clip combinations have been described in the patent literature. For example, U.S. Pat. Nos. 3,823,967 issued to Knize, 4,020,532 issued to Lichter, 4,927,118 issued to Pierorazio, 4,955,572 issued to Simmons, 4,961,510 issued to Dvoracek, 4,984,723 issued to Hsu, 5,109,995 issued to Lou, 5,167,354 issued to Cohanfard, 5,232,116 issued to Baxter, 5,433,339 issued to Sarver, 5,609,277 issued to McDonald, 5,676,285 issued to Vinarsky, Des. 273,247 issued to Pigott, Des. 278,188 issued to Burns, and Des. 363,852 issued to Young all fail to disclose or suggest a lid and clip combination for a child's drink wherein the lid and clip combination allows the parent to attach the lid to a child's cup and then attach the clip to the child's belt therefore securing the cup to the child's side.

None of the above inventions and patents, taken either singly or in combination, is seen to describe the instant invention as claimed.

SUMMARY OF THE INVENTION

The invention relates to a lid and clip combination for a child's drinking cup wherein the lid is permanently attached to a clip or the lid and clip are molded together to form a unitary construction. The lid is designed to secure to the top part of a cup designed to hold liquid wherein the cup is of a size and shape suitable for small children. The lid comes in various sizes all of which are designed with the express purpose of securing the various lids to cups especially designed for children. The clip also comes in various shapes and designs including, but not limited to, the form of various figurines. The clip secures the various lids and therefore the associated cups especially designed for children to the child's belt or car seat. The clip and is made of a flexible material such as a flexible plastic and serves the same purpose as a clip for a pager or cell phone. The bottom part of the clip is rounded to prevent puncture either to the child's clothing or skin. The lid has a specialized drinking spout which is raised above the generally horizontal surface of the lid. The raised drinking spout has drinking holes therein which provide means to extract the liquid from the cup. Located along the horizontal surface of the lid are a plurality of air holes. A first set of air holes are located adjacent the clip while a second set of air holes are located adjacent the drinking spout. With the lid and clip combination properly secured to the cup the child can safely attach the clip, and therefore the cup, to his or her waist band or belt and proudly and confidently walk around having immediate access to the cup and consequently, the liquid therein.

Accordingly, it is a principal object of the invention to provide a combination lid and clip.

It is another object of the invention to provide a combination lid and clip attachable to children's cups.

It is a further object of the invention to provide a combination lid and clip wherein the clip is molded to the lid to form a unitary construction.

Still another object of the invention is to provide a combination lid and clip wherein the clip is permanently attached to the lid.

It is again an object of the invention to provide a combination lid and clip wherein the clip is made of a flexible material like a flexible plastic.

Yet another object of the invention is to provide a combination lid and clip wherein a drinking spout is raised and is part of the lid.

Again, it is an object of the invention to provide a lid and clip combination wherein the lid has a plurality of air holes.

A further object of the invention is to provide a combination lid and clip wherein the clip is attachable to a child's waist band, belt or car seat.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The invention relates to a combination lid and clip attachment for a child's drinking cup wherein the lid is, in one embodiment, permanently attached to a clip or in a second embodiment the lid and clip are molded together to form a unitary construction. The lid is designed to secure to the top part of a cup designed to hold liquid wherein the cup is of a size and shape suitable for small children. The lid comes in various sizes all of which are designed with the express purpose of securing the various lids to cups especially designed for children. The clip also comes in various shapes and designs and is made of a flexible material such as a flexible plastic and serves the same purpose as a clip for a pager or cell phone. The bottom part of the clip is rounded to prevent puncture either to the child's clothing or skin. The lid has a specialized drinking spout which is raised above the generally horizontal surface of the lid. The raised drinking spout has drinking holes therein which provide means to extract the liquid from the cup. Located along the horizontal surface of the lid are a plurality of air holes. A first set of air holes are located adjacent the clip while a second set of air holes are located adjacent the drinkg spout. With the lid and clip combination properly secured to the cup the child can safely attach the clip, and therefore the cup, to his or her waist bind or belt and proudly and confidently walk around having immediate access to the cup and consequently, the liquid therein.

Figure 1:
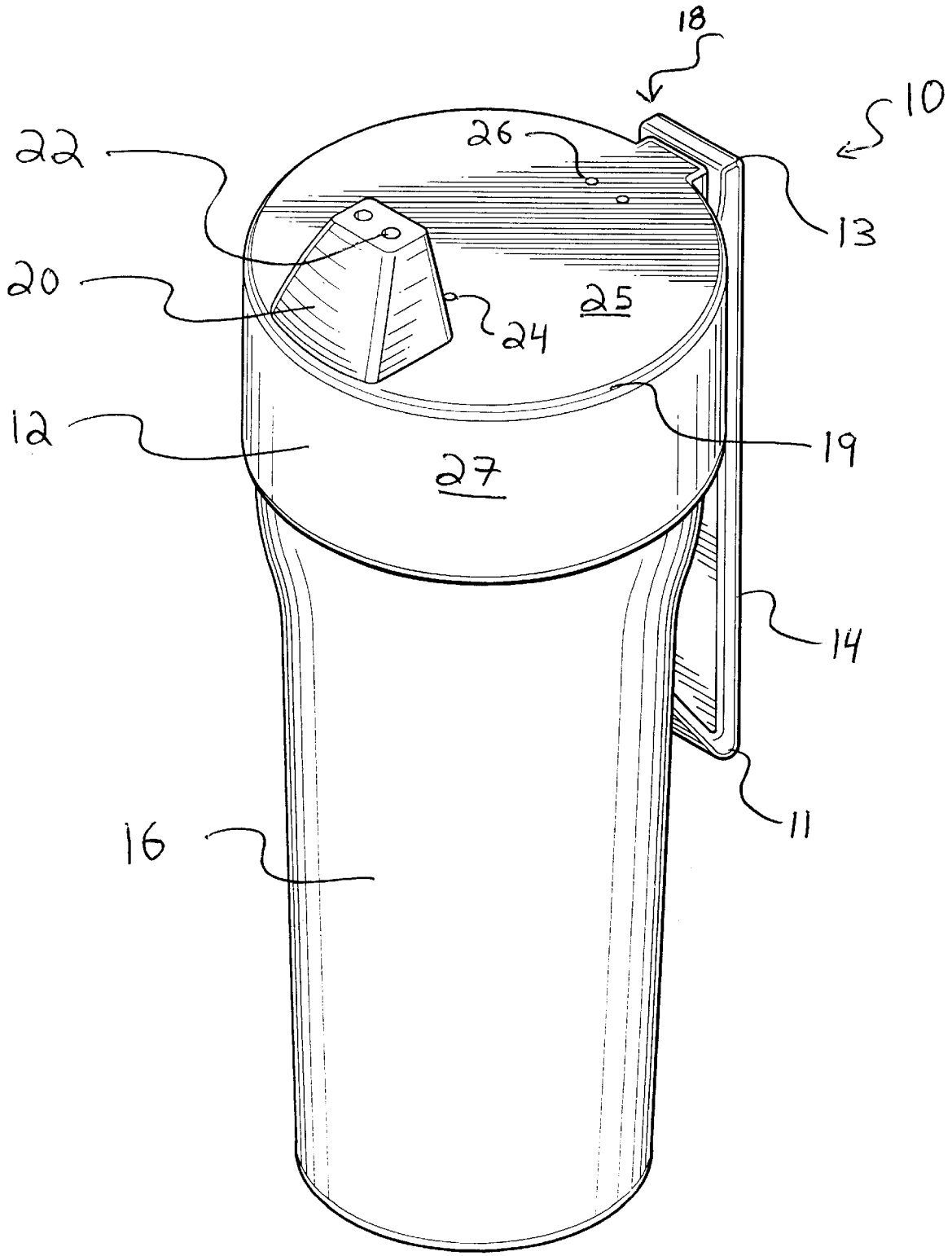
FIG. 1 is an perspective view of the preferred embodiment.

Turning now to FIG. 1 of the drawings, a combination lid and clip is seen generally at 10 wherein a lid 12 is attached to a clip 14 such that when lid 12 is attached to cup 16 the clip 14 can be secured to a belt (not shown), thereby securing the cup 16 to the wearer's body. Lid 12 secures to cup 16 by means generally well known in the art which include threads or snap fits. Lid 12 has a top 25 which is substantially horizontal and an edge 19 located on the outermost part of lid 12. A substantially vertical side 27 depends in a vertical direction from top 25. An outlet means or raised mouth portion 20 is located along or adjacent to the edge 19 of lid 12. Located at the top of the raised mouth portion 20 are drink holes 22. The drink holes 22 allow liquid contained in cup 16 to escape in a controlled manner as to limit or reduce spillage. A plurality of air holes 24, 26 are located on top 25 of lid 12. A first set of air holes 26 are located adjacent clip 14 whereas a second set of air holes 24 are located adjacent raised mouth portion 20. Positioned diametrically opposite of raised mouth portion 20 is clip 14. Clip 14 is made of a flexible material such as a flexible plastic. While flexible, clip 14 is sturdy enough to secure the lid and cup, with liquid contained therein, to the belt of the wearer. Clip 14 has an upper portion 13 and lower portion 11. Upper portion 13 is attached to lid 12 along edge 19, seen generally at numeral 18, in a similar way a clip is attached to a pager or cell phone. Lower portion 11 is rounded at the end to protect the child from puncture wounds.

Figure 2:
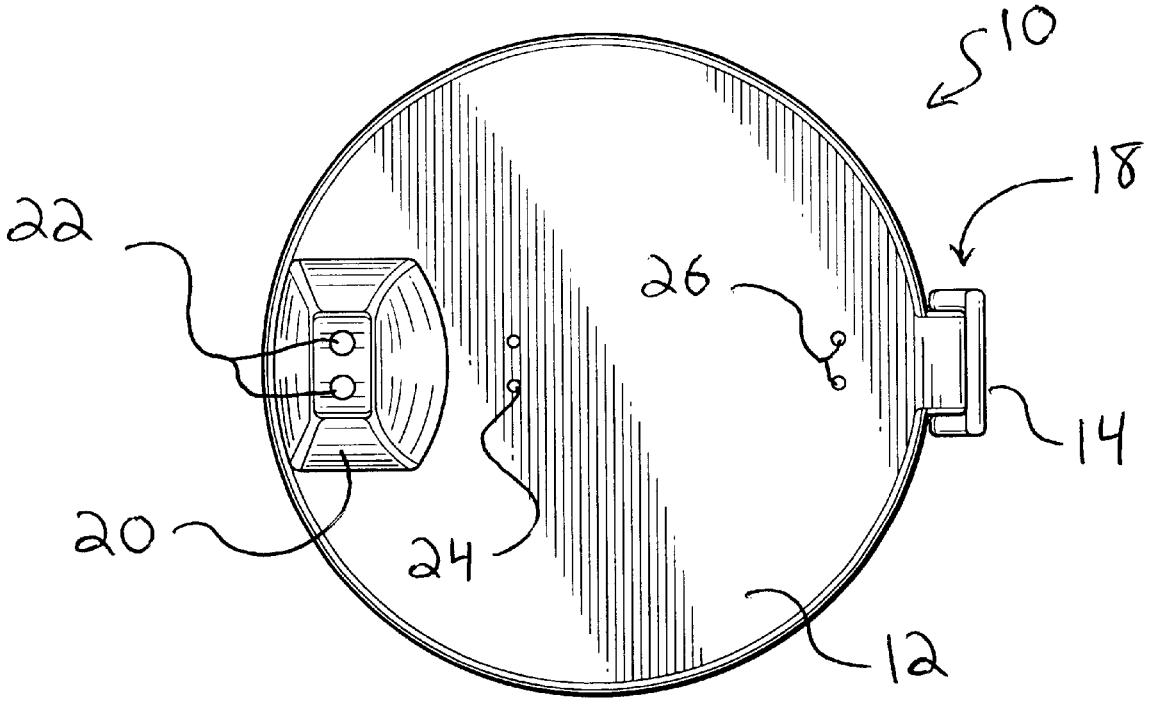
FIG. 2 is a top view of the preferred embodiment.
Figure 3:
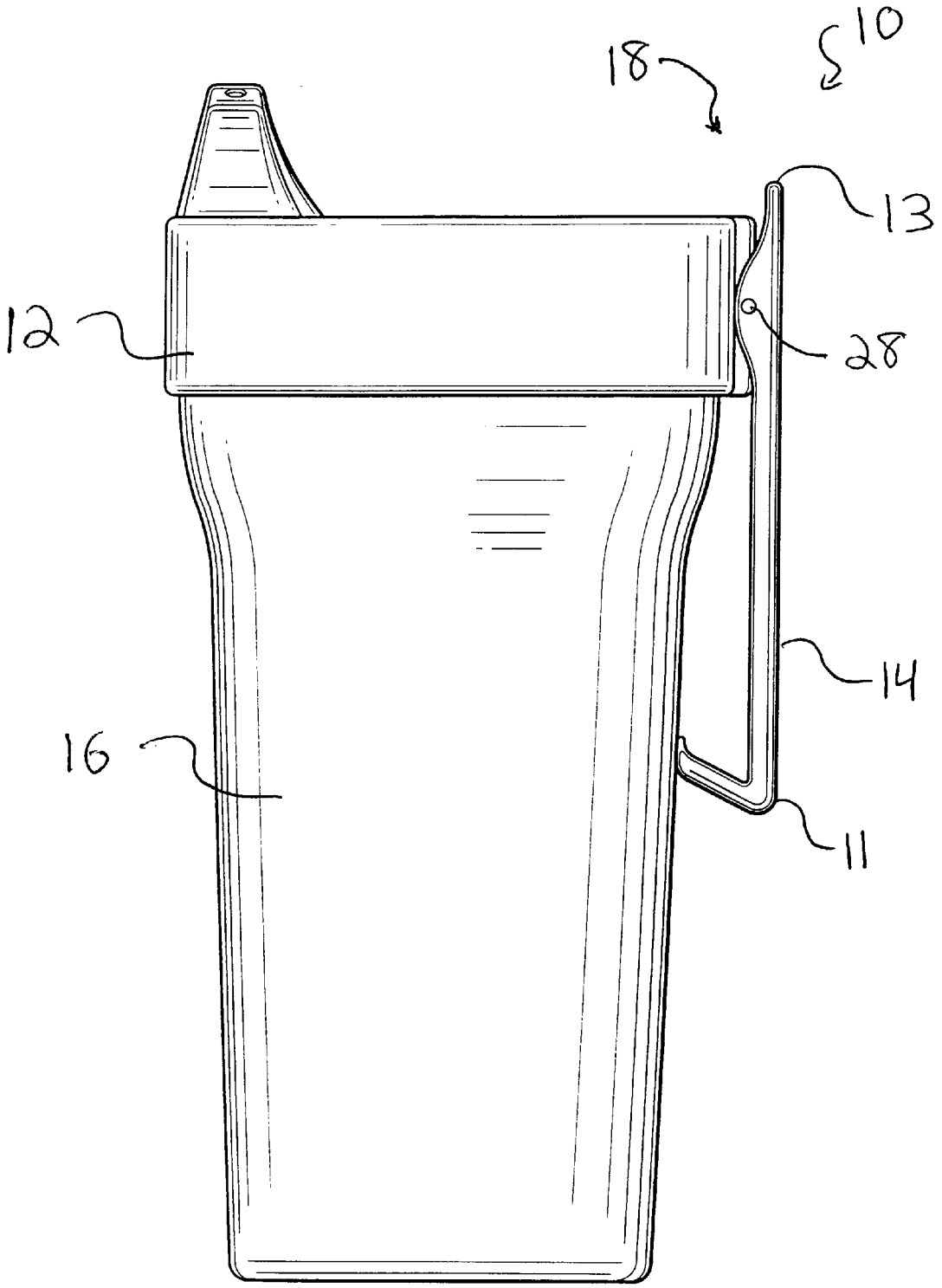
FIG. 3 is a right side view of the preferred embodiment.

FIG. 2 of the drawings illustrates the lid and clip combination 10 in a top view whereas Fig. 3 shows the same combination 10 in a right side view. Pin 28 is used to secure clip 14 to lid 12 such that clip 14 is able to rotate slightly about pin 28. This slight rotation ability about pin 28 gives clip 14 added flexibility when the child attempts to secure clip 14 to his or her belt. The added flexibility allows the child to push inward on the upper portion 13 of clip 14, which puts some separation between cup 16 and the lower portion 11 of clip 14, thus making it easier for the child to secure the combination 10 to his or her belt.

Figure 4:
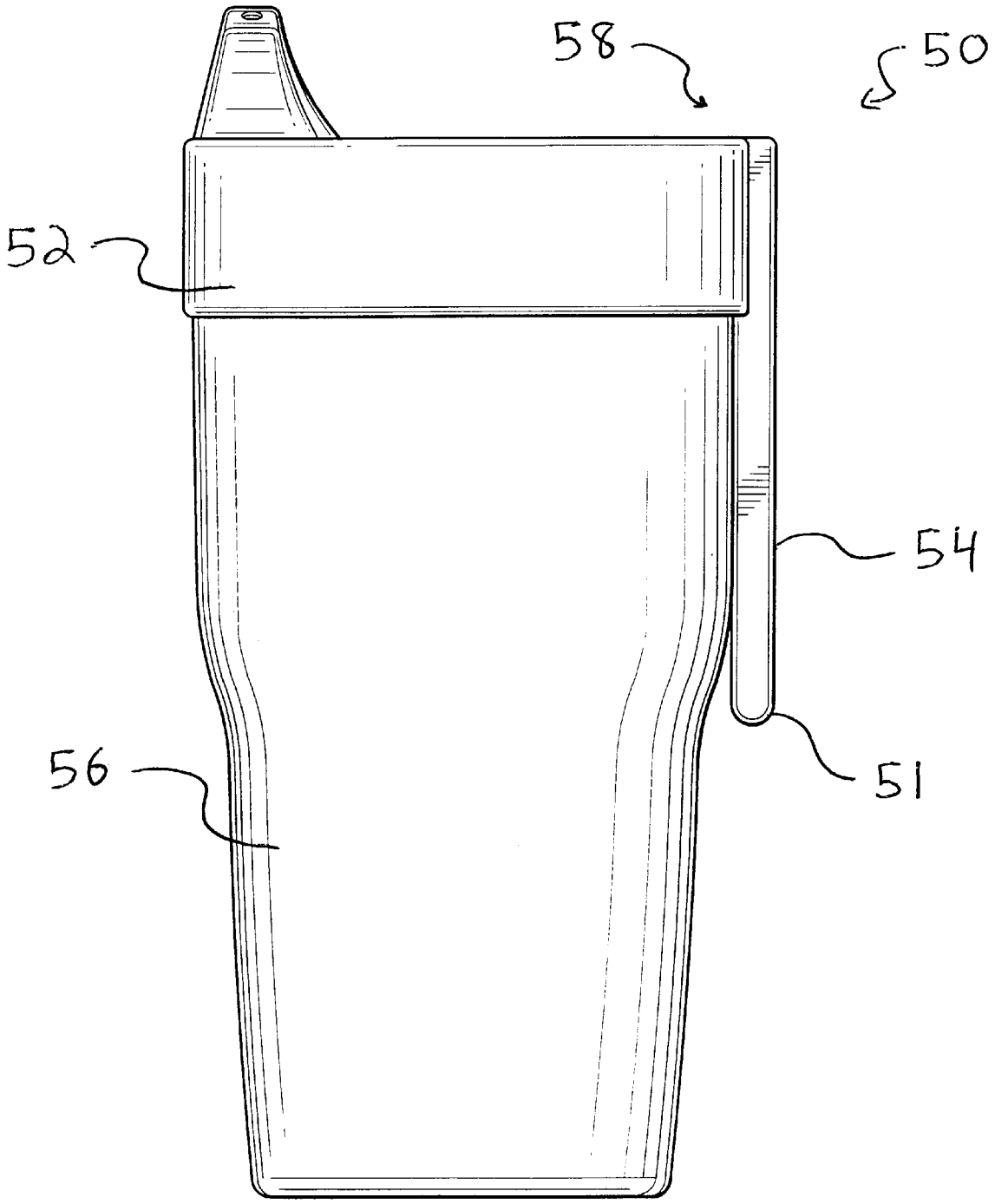
FIG. 4 is a right side view of a second embodiment.

FIG. 4 of the drawings shows a lid and clip combination 50 wherein the lid 52 is made substantially the same as the lid of the first embodiment, the only difference being that the clip 54 and lid 52 are molded together to form a unitary construction. The lid and clip combination 50, as with the first embodiment, allow the child to securely attach cup 56 to his or her waist band or belt in a manner that gives confidence and security to the child. Clip 54 is made of a flexible material and is flexible such that lower portion 51 can be slightly pulled outwards away from cup 56 such that a child can easily attach the cup 56 and combination 50 to his or her belt.

Figure 5:
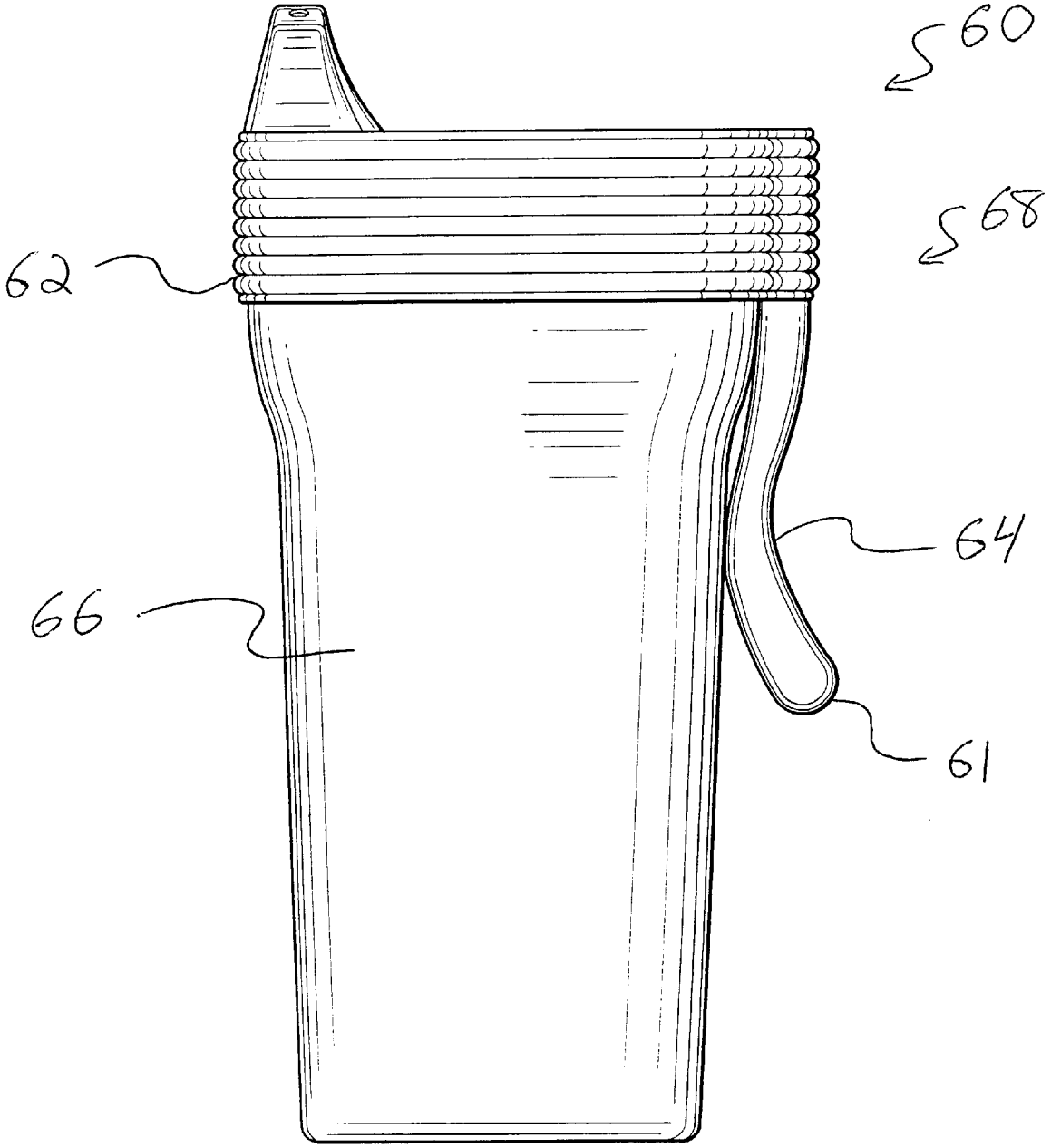
FIG. 5 is a right side view of a third embodiment.

FIG. 5 of the drawings shows a lid and clip combination 60 made substantially like the combination of FIG. 4 in that the lid 62 and clip 64 are molded together to form a unitary construction. The combination 60 differs from the combination of FIG. 4 in that the lower portion 61 of clip 64 has a distinct outward curve which greatly assists small children in securing the cup 66 and combination 60 to their belts.

It is to be understood that the present invention is not limited to the sole embodiment described above, but encompasses any and all embodiments within the scope of the following claims.

I claim:

1. A lid and clip combination attachable to a cup having liquid therein comprising:

a lid having a top wherein said top is substantially horizontal;

said lid having a side wherein said side depends from said top in a substantially vertical direction;

said lid having an edge;

outlet means located on said top for removing liquid located within the cup;

a clip attached to said lid wherein said clip has an upper portion and a lower portion;

a plurality of first air holes located on said top;

a plurality of second air holes located on said top;

wherein said outlet means is raised in a substantially vertical direction from said top and wherein said outlet means has drinking holes;

wherein said clip and said outlet means are located opposite each other on said top wherein said clip is located along said edge of said lid and wherein said plurality of first air holes are located in close proximity to said clip wherein said plurality of second air holes are located in close proximity to said outlet means and wherein said clip is made of a flexible material permitting said clip to bend; and wherein said clip is rounded at said lower portion to prevent puncture.

2. The combination according to claim 1 wherein said clip is attached to said lid via a securing pin such that said clip can rotate about said securing pin.

3. The combination according to claim 1 wherein said clip is attached to said lid such that said lid combined with said clip is sufficient to hold the cup and liquid therein.

4. The combination according to claim 1 wherein said clip is molded to said lid such that said lid and said clip are made of a unitary construction.

5. The combination according to claim 4 wherein said lower portion of said clip is curved away from the cup.

* * * * *